US011022115B2

(12) United States Patent
Vacca et al.

(10) Patent No.: US 11,022,115 B2
(45) Date of Patent: Jun. 1, 2021

(54) CONTROLLED VARIABLE DELIVERY EXTERNAL GEAR MACHINE

(71) Applicant: Purdue Research Foundation, West Lafayette, IN (US)

(72) Inventors: Andrea Vacca, Lafayette, IN (US); Srinath Tankasala, Boston, MA (US)

(73) Assignee: Purdue Research Foundation, West Lafayette, IN (US)

( * ) Notice: Subject to any disclaimer, the term of this patent is extended or adjusted under 35 U.S.C. 154(b) by 264 days.

(21) Appl. No.: 15/993,505

(22) Filed: May 30, 2018

(65) Prior Publication Data

US 2018/0347564 A1 Dec. 6, 2018

Related U.S. Application Data

(60) Provisional application No. 62/514,704, filed on Jun. 2, 2017.

(51) Int. Cl.
*F04C 2/18* (2006.01)
*F04C 2/08* (2006.01)
(Continued)

(52) U.S. Cl.
CPC ..... *F04C 14/18* (2013.01); *F04C 2/18* (2013.01); *F04C 2240/811* (2013.01)

(58) Field of Classification Search
CPC .. F04C 2/18; F04C 2/086; F04C 14/18; F04C 15/06; F04C 2240/30; F04C 2/088;
(Continued)

(56) References Cited

U.S. PATENT DOCUMENTS 1,912,737 A 6/1933 Svenson
2,498,790 A * 2/1950 Caughrean ..... F04C 2/088 418/189

(Continued)

FOREIGN PATENT DOCUMENTS

CA 2796593 5/2013
EP 0478514 9/1991

(Continued)

OTHER PUBLICATIONS

Zavandika, Development of a Variable Roller Pump and Evaluation of its Power Saving Potential as a Charge Pump in Hydrostatic Drivetrains, Ph.D. Thesis, Brno University of Technology, 2015.

(Continued)

*Primary Examiner* — Deming Wan
(74) *Attorney, Agent, or Firm* — Piroozi-IP, LLC

(57) ABSTRACT

A controlled variable delivery external gear machine (VD-EGM). The VD-EGM includes a housing, an inlet, a drive gear, a driven gear, the drive gear configured to engage the driven gear in an angular mesh zone, an outlet, a first slider comprising a first longitudinal portion connected to a second longitudinal portion such that longitudinal forces applied to the first and second longitudinal portions substantially cancel each other thereby requiring between about 0 N to about 20 N to longitudinally moving the first slider, selective positioning of the first slider configured to vary net operational volumes of fluid communication between the inlet and the outlet, for a given rotational speed of the drive gear, and a first drive mechanism coupled to the first slider and configured to cause the first slider to slide in a longitudinal direction.

20 Claims, 16 Drawing Sheets

(51) Int. Cl.

| | |
|---|---|
| ***F04C 14/12*** | (2006.01) |
| ***F04C 2/06*** | (2006.01) |
| ***F01C 20/18*** | (2006.01) |
| ***F01C 21/18*** | (2006.01) |
| ***F01C 21/10*** | (2006.01) |
| ***F04C 14/18*** | (2006.01) |

(58) Field of Classification Search
CPC .. F03C 2/08; F01C 20/18; F01C 21/18; F01C 21/08; F01C 21/10
See application file for complete search history.

(56) References Cited

U.S. PATENT DOCUMENTS

| | | | | |
|---|---|---|---|---|
| 3,481,275 | A * | 12/1969 | Gelin | F04C 15/0046 418/133 |
| 4,902,202 | A | 2/1990 | Bowden | |
| 5,397,219 | A * | 3/1995 | Cretors | F04C 14/26 137/107 |
| 6,099,263 | A * | 8/2000 | Bodzak | F04C 14/26 417/295 |
| 6,171,089 | B1 | 1/2001 | Oehman, Jr. | |
| 6,699,151 | B2 | 3/2004 | Grogg et al. | |
| 7,267,532 | B2 | 9/2007 | Krebs | |
| 8,622,717 | B1 * | 1/2014 | Osterhaus | F04C 2/18 417/310 |
| 2001/0024618 | A1 | 9/2001 | Winmill | |
| 2002/0104313 | A1 | 8/2002 | Clarke | |
| 2008/0044308 | A1 | 2/2008 | Hoji et al. | |
| 2016/0369795 | A1 | 12/2016 | Vacca et al. | |

FOREIGN PATENT DOCUMENTS

| | | |
|---|---|---|
| GB | 781697 | 8/1957 |
| GB | 968998 | 9/1964 |

OTHER PUBLICATIONS

Vacca et al., Modelling and experimental validation of external spur gear machines for fluid power applications, Simulation Modelling Practice and Theory, 2011, 2007-2031, vol. 19, Elsevier B.V.
Nieling et al., Design of a Virtually Variable Displacement Pump/Motor, NCFP, 2005, 323-335.
Vacca et al., A Flow Control System for a Novel Concept of Variable Delivery External Gear Pump,10th International Fluid Power Conference, 2016, 263-276.
Devendran et al., Theoretical analysis for variable delivery flow external gear machines based on asymmetric gears, Mechanism and Machine Theory, 2016, 123-141, vol. 108, Elsevier Ltd.
Rundo et al., Lubrication pumps for internal combustion engines: a review, International Journal of Fluid Power, 2015, 59-74, vol. 16, No. 2.
Devendran et al., Optimal design of gears and lateral bushes of external gear machines, Fluid Power and Motion Control, 2012, 29-48.
Gulati et al., A General Method to Determine the Optimal Profile of Porting Grooves in Positive Displacement Machines: The Case of External Gear Machines, 10th International Fluid Power Conference, 2016, 453-464.
Zhao et al., Numerical analysis of theoretical flow in external gear machines, Mechanism and Machine Theory, 2016, 41-56, vol. 108, Elsevier Ltd.
Devendran et al., Optimal design of gear pumps for exhaust gas after treatment applications, Simulation Modelling Practice and Theory, 2013, Elsevier B.V.
Devendran et al., A novel design concept for variable delivery flow external gear pumps and motors, International Journal of Fluid Power, 2014, 121-137, vol. 15, Taylor & Francis Group.
Hintzsche, Variable Flow Rotor Pump, Fluid Power Innovation & Research Conference, 2016, Minneapolis, MN.

* cited by examiner

CONTROLLED VARIABLE DELIVERY EXTERNAL GEAR MACHINE

CROSS-REFERENCE TO RELATED APPLICATIONS

The present patent application is related to and claims the priority benefit of U.S. Provisional Patent Application Ser. No. 62/514,704, filed Jun. 2, 2017, the contents of which is hereby incorporated by reference in its entirety into the present disclosure.

STATEMENT REGARDING GOVERNMENT FUNDING

This invention was made with government support under 1543078 awarded by the National Science Foundation. The government has certain rights in the invention.

TECHNICAL FIELD

The present application relates to gear machines, and specifically to external gear machines used in fluid power management systems.

BACKGROUND

This section introduces aspects that may help facilitate a better understanding of the disclosure. Accordingly, these statements are to be read in this light and are not to be understood as admissions about what is or is not prior art.

External gear machines (EGMs) are used as primary flow supply units in many applications such as fuel injection systems, small mobile applications such as micro-excavators, turf and gardening machines. EGMs are also used in fixed applications such as hydraulic presses and forming machines. EGMs also find applications in auxiliary systems such as hydraulic power steering, fan drive systems and as charge pump in hydrostatic transmissions.

Referring to FIG. 1, an exploded perspective view of an EGM 100 of prior art is used as disclosed in WIPO publication WO2015131057. The EGM 100 includes a housing 112, a drive gear 114, which drives a driven gear 116, both disposed inside the housing 112. The drive gear 114 and the driven gear 116 are supported by bushings 118A and 118B inside the housing 112. The drive gear 114 and the driven gear 116 are coupled together in a mesh zone (depicted in FIG. 2) where a plurality of their respective teeth comes into contact with each other. End caps 126 and 128 enclose the housing 112 and are coupled to the housing by fasteners 119, where the end cap 126 provides a journal support 127 for endshaft 115 of the drive gear 114. The EGM 100 also includes an outlet 122 and an inlet 124. The EGM also includes end caps 126 and 128, The EGM 100 also includes sliders 120A and 120B. These sliders 120A and 120B are coupled to the respective bushings 118A and 118B. A sealing member is fastened to the housing 120. The positioning and coupling of the sliders 120A and 120B with respect to the bushings 118A and 118B is described below with reference to FIG. 2.

Referring to FIG. 2, a plane view of the drive gear 114 and the driven gear 116 in engagement with each other is provided. The drive gear 114 has a plurality of teeth, exemplified by 202A and 202B, while the driven gear 116 also has a plurality of teeth, exemplified by 204A and 204B. Tooth space volume 206 is identified as the space between any two consecutive teeth. Within this space, fluid is picked up and then trapped between any two consecutive teeth of the drive gear 114 and any two consecutive teeth of the driven gear 116 and the housing 112. The engagement of the teeth creates a mesh zone 210 identified as the angular portion θ, and shown in FIG. 3. The tooth space volume 206 is a variable that is constant for most of its rotational path but begins to decrease and then increase within the mesh zone 210.

The mesh zone shown in FIG. 3 is divided into four portions. The first portion (identified as 1 in a circle) is the upper portion in FIG. 2, where the teeth just begin to engage each other. This portion is identified as the space between mesh-zone-start 214A and upper-exterior-portion 216A. As the teeth from both the drive gear 114 and the driven gear 116 come together in the first portion of the mesh zone (1), the space volumes 206 of the respective gears begin to interfere with each other and the overall tooth space volumes 206 decrease. As the tooth space volumes 206 decrease, fluid pressure increases, causing ejection of fluid through the outlet 122 at an output pressure. At this point fluid begins to be ejected from the EGM 100 via an outlet grove 222 (also referred to as the outlet fluid communication channel), identified in dashed lines for clarity, positioned below the mesh zone 210 as well as openings (not shown) to the outlet 122. The bottom of the first portion is identified by the point "D" which signifies a point in the rotation where the teeth have trapped the fluid in the associated tooth space volumes 206 as a result of contact with each other. Beyond point "D" the only path for ejection of fluid is through the outlet groove 222 to the outlet 122. In other words, point "D" corresponds to the switch point between i) fluid ejection via the outlet groove 222 and other openings (not shown) to ii) fluid ejection via the outlet groove 222 only by isolating tooth space volumes 206 with the outlet groove 222.

The second portion (identified as 2 in a circle in FIG. 3) is the upper-interior portion in FIG. 2. This portion is identified as the space between the upper-exterior-portion 216A and the centerline 218. As the tooth space volume decreases, fluid pressure increases. In this portion the teeth come in contact with each other and trap the fluid within the shrinking tooth space volume 206.

Somewhere in this portion, the outlet groove ends, at which point fluid is no longer able to be ejected via the outlet groove 222. At the center 212 of mesh zone 210 the tooth space volumes 206 are minimized. At any point beyond the center 212, the tooth space volume 206 begins to increase.

The third portion (identified as 3 in a circle in FIG. 3) is the lower-interior portion in FIG. 2. This portion is identified as the space between the centerline 218 and lower-exterior-portion 216B. In this portion the teeth remain in contact with each other and continue to trap the fluid, however, now the tooth space volumes 206 begin to increase. Somewhere in this portion (3), an inlet groove 224 (also referred to as the inlet fluid communication channel), shown in dashed lines for clarity, ends; at which point fluid that is isolated to the inlet groove 224 can begin to be sucked in via the inlet groove 224 from the inlet 124. The end of portion 3 is designated as "S" in FIG. 3, corresponding to a switch point between i) fluid suction via the inlet groove 224 only by isolating tooth space volumes 206 with the inlet groove 224 to ii) fluid suction via the inlet groove 224 and other openings (not shown) to the inlet 124.

The fourth portion (identified as 4 in a circle in FIG. 3) is the lower portion in FIG. 2, where the teeth just begin to separate from each other. This portion is identified as the space between lower-exterior-portion 216B and mesh-zone-end 214B. As the teeth from both the drive gear 114 and the driven gear 116 come apart from each other in the fourth portion of the mesh zone (4), the space volumes 206 of the respective gears continue to expand. As the tooth space volumes 206 increase, the fluid pressure decreases causing suction of fluid from the inlet 124 at an inlet pressure. At this point fluid continues to be sucked into the EGM 100 via the inlet grove 224 positioned below the mesh zone 210 as well as openings (not shown) to the inlet 124.

The sliders 120A and 120B are positioned relative to each other so that placement of one determines the position of the other. The sliders 120A and 120B have a first end that sees pressure at the outlet 122, and a second end that sees pressure at the inlet 124. The cross-section of these two ends is about the same, namely A.

While, the sliders 120A and 120B provide the ability to selectively adjust displaced volume as seen in FIG. 3, the design of the sliders 120A and 120B and the fact that at least portions of the sliders 120A and 120B are under high pressure and therefore have large forces acting on them, it is impractical to dynamically adjust position of the sliders 120A and 120B of the prior art. In particular, the forces acting on one of these sliders is $F=(P2-P1)\cdot A$, where P2 is the outlet pressure, P1 is the inlet pressure, and A is the cross-sectional area of the first end and the second end of the sliders 120A and 120B. Since both sliders 120A and 120B slide together, any sort of dynamic adjustment must be capable of overcoming 2*F. In certain applications these forces can reach hundreds of newtons.

There is, therefore, an unmet need for a novel approach to provide dynamic variable flow in gear machines.

SUMMARY

A controlled variable delivery external gear machine (VD-EGM) is disclosed. The VD-EGM includes a housing, an inlet, a drive gear, a driven gear, the drive gear configured to engage the driven gear in an angular mesh zone, an outlet, a first slider comprising a first longitudinal portion connected to a second longitudinal portion such that longitudinal forces applied to the first and second longitudinal portions substantially cancel each other thereby requiring between about 0 N to about 20 N to longitudinally moving the first slider, selective positioning of the first slider configured to vary net operational volumes of fluid communication between the inlet and the outlet, for a given rotational speed of the drive gear, and a first drive mechanism coupled to the first slider and configured to cause the first slider to slide in a longitudinal direction.

DETAILED DESCRIPTION

Figure 1:
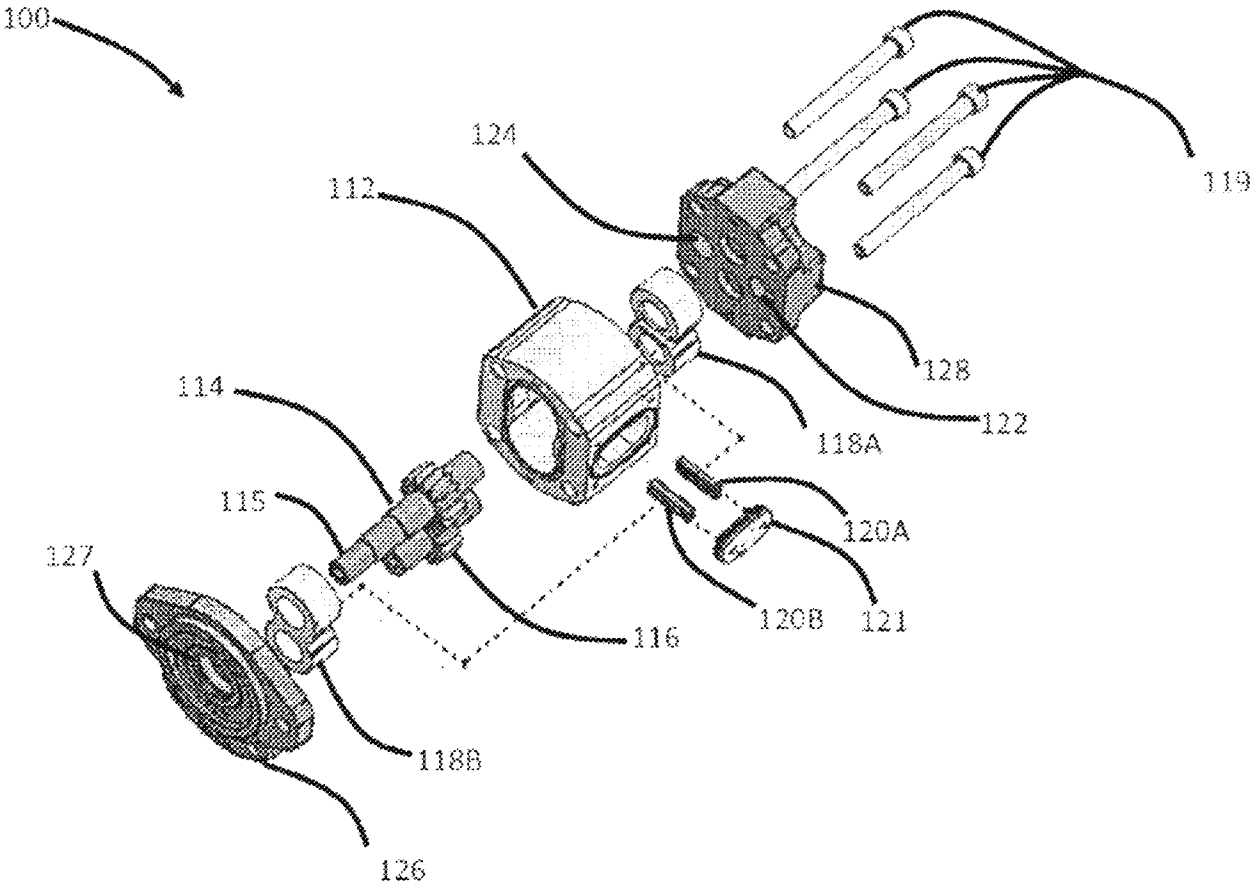
FIG. 1 (Prior Art)
FIG. 1 is a schematic of an external gear machine of the prior art depicting an exploded perspective view of various components including a drive gear and a driven gear each with a plurality of teeth.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

In the present disclosure, the term "about" can allow for a degree of variability in a value or range, for example, within 10%, within 5%, or within 1% of a stated value or of a stated limit of a range.

In the present disclosure, the term "substantially" can allow for a degree of variability in a value or range, for example, within 90%, within 95%, or within 99% of a stated value or of a stated limit of a range.

Figure 4:
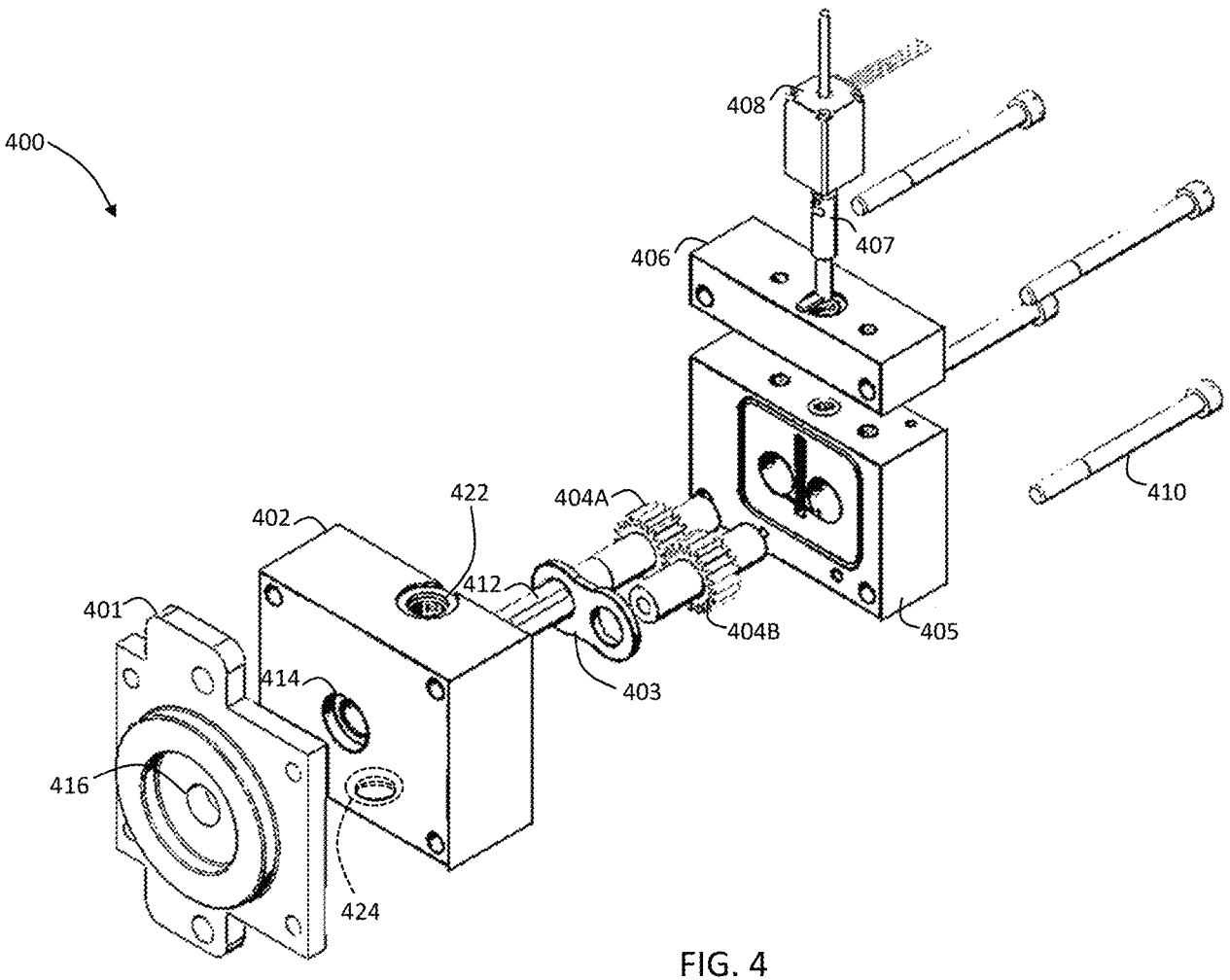
FIG. 4 is a schematic of a controlled variable delivery external gear machine (VD-EGM) according to the present disclosure depicting an exploded perspective view of various components including a drive gear and a driven gear each with a plurality of teeth shown engaged therewith, a front cover, a back cover and casing having an inlet and an outlet, a first slider disposed in the front cover.

Referring to FIG. 4, an exploded perspective view of a variable displacement external gear machine (VD-EGM) 400 according to one embodiment of the present disclosure is provided. The VD-EGM 10 includes a flange 401, a back cover and casing 402 having an outlet 422 and an inlet 424, a lateral plate 403, a drive gear 404A and a driven gear 404B, a front cover 405, a front cover top plate 406, a slider 407, an actuator 408, and a plurality of fastening members 410. It should be appreciated that the lateral plate 403 shown is optional for improved surface mating and is not required in all embodiments according to the present disclosure. While not intended to be a limiting factor of the VD-EGM 400 of the present disclosure, one difference between the VD-EGM 400 of the present disclosure and the EGM of the prior art for high pressure applications (e.g., with reference to FIG. 1), is the VD-EGM 400 of the present disclosure does not require axial compensations; therefore, the lateral grooves controlled by the sliders 120A and 120B (FIG. 1) can be realized directly on the front cover 405 of the VD-EGM 400. The actuator 408 is mechanically coupled to the slider 407 and is configured to force the slider up and down in the respective cavities of front cover 405 and front cover top plate 406 as will be discussed in more detail below. The outlet 422 is configured to eject fluid at a selective variable flow rate and the inlet 424 is configured to receive fluid at a selective variable flow rate. The drive gear 404A is coupled to and driven by a drive shaft 412 that passes through and is supported by collars 414 and 416 of the back cover and casing 402 and the flange 401, respectively, and by a corresponding collar (not numbered) on the front cover 405. The driven gear 404B is similarly supported by collars (not shown) in the back cover and casing 402 and the flange 401, respectively, and by a corresponding collar (not numbered) on the front cover 405. Both the drive gear 404A and the driven gear 404B are received in a cavity in the back cover and casing 402 (see cavity 420 in FIG. 11, discussed below). The fastener members 410 pass through the front cover 405 and the back cover and casing 402 and thread into the flange 401 in order to bring these components in fluid operations together.

The design of the slider 407 represents an important aspect of the VD-EGM 400. One of the goals realized by the design of the slider 407 is to minimize the longitudinal forces (i.e., vertical forces in FIG. 4) acting on the slider resulting from the fluid pressure. This requirement is to permit a low force actuation of the VD-EGM 400, so that the flow can be varied without significant energy consumption. This arrangement permits a low energy actuation by the actuator 408. While a stepper motor is depicted in FIG. 4 for the actuator 408, it should be appreciated that other electromechanical and electrohydraulic approaches, including motors, cams, belts, and/or chains, known to a person having ordinary skill in the art, and electrohydraulic approaches known to a person having ordinary skill in the art can be used to effect the up and down motion of the slider 407.

Figure 5:
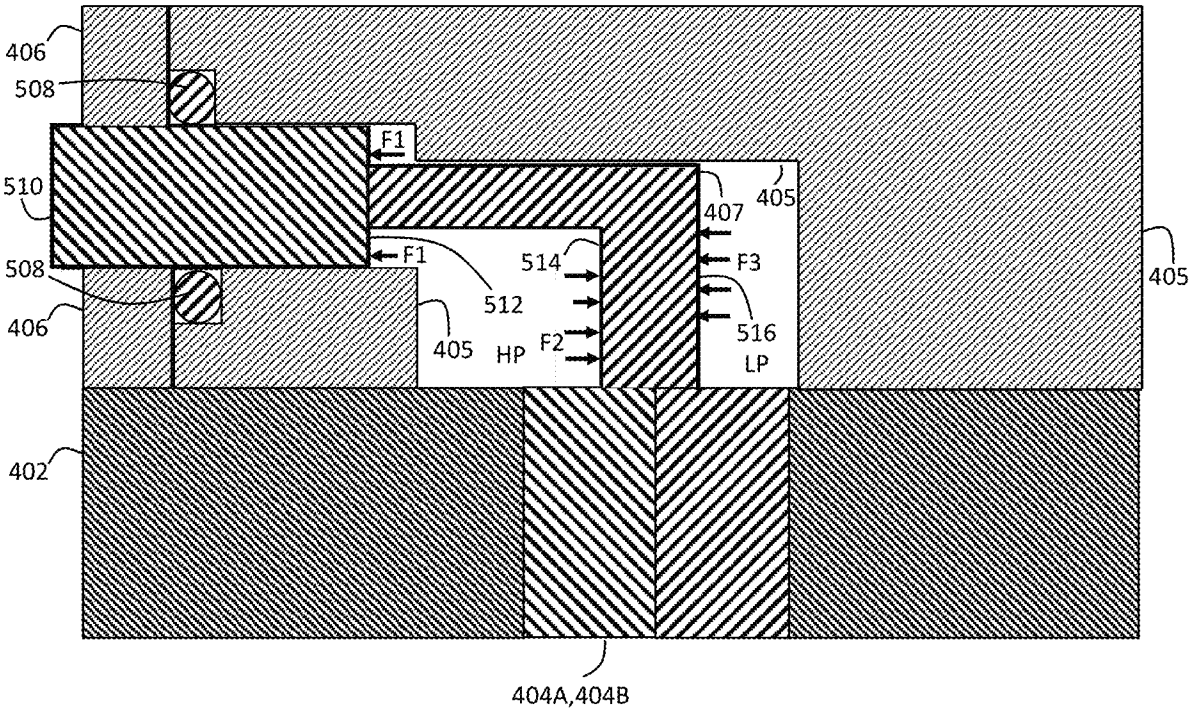
FIG. 5 is a schematic cross-sectional view of various components of the VD-EGM of the present disclosure depicting the first slider in a juxtaposed position with respect to the drive and driven gears of FIG. 4, according to the present disclosure.

The slider 407 is now discussed in relationship with FIGS. 5, 6, 7A, 7B, 7C, 7D, and 8. FIG. 5 is a schematic view of the slider 407 disposed in the front cover 405 and coupled to the drive and driven gears 404A and 404B. The slider 407 is an L-shaped member with three zones of interest. The bottom (right side of the foot of the slider 407) is a low-pressure zone 516 (marked in FIG. 5 as "LP"). The central portion of the slider 407 (left side of the foot of the slider 407) is situated in high-pressure zones 514 and 512, having the same high pressure side as the outlet 422 (see FIG. 4). The top 510 of the slider 407 protruding out of the top plate 406 is mechanically coupled to the actuator 408. A seal 508 (e.g., an O-ring) dynamically seals the slider 407 against the front cover 405 and the top plate 406. The high-pressure zones 512 and 514 are designed to generate opposing forces (high-pressure zone 512 generates longitudinal force F1 which is pressure times the area of the high-pressure zone 512 while high-pressure zone 514 generates longitudinal force F2 which is pressure times the area of the high-pressure zone 514, opposite F1). Depending on the application in which the VD-EGM 400 used, e.g., whether the low-pressure is at atmosphere or below or above atmospheric pressure, the low-pressure zone 516 generates longitudinal force F3 which is pressure times the area of the low-pressure zone 516. The slider 407 is thus designed such that F1+F3−F2 is about zero. F3 can be ignored if the low-pressure is atmosphere. While no force is shown acting on the top 510, a force can be used (either from atmospheric pressure, or an external force other than the actuator). If so, that force (e.g., F4) would be used in the algebraic relationship provided above between the other forces with the appropriate sign depending on the direction of the force.

Figure 6:
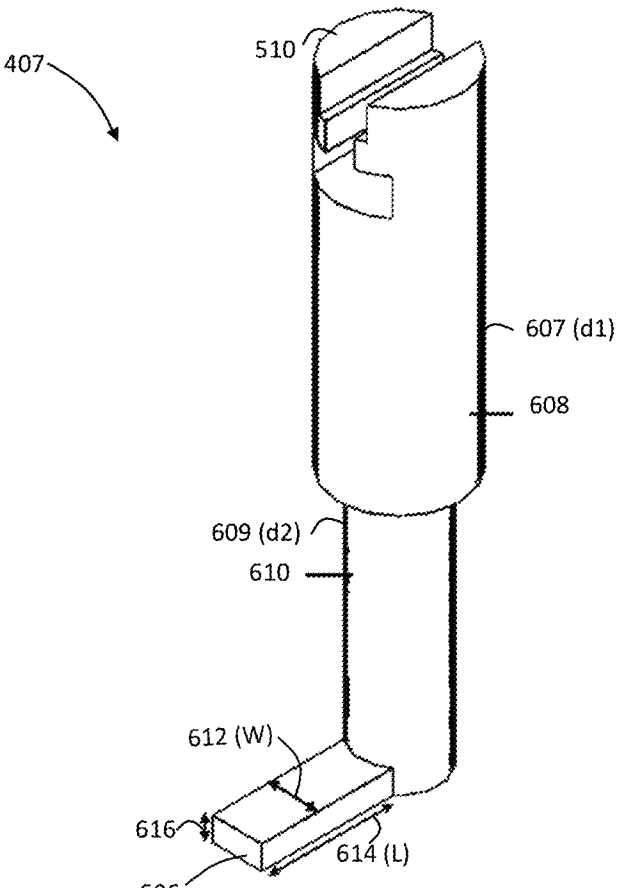
FIG. 6 is a schematic perspective view of the first slider of FIG. 4, according to the present disclosure.

Referring to FIG. 6, a perspective view of the slider 407 is provided. The slider 407 comprises two longitudinal portions 608 having a larger outer dimension and 610 having a smaller outer dimensions. While a cylindrical-shaped slider with a rectangular foot is discussed above and shown in the figures of the present disclosure, it should be appreciated that other shapes, e.g., elliptical and non-rectangular foot shapes, are also within the scope of the present disclosure.

The longitudinal portion 608 is sealingly coupled to the front cover 405 via the seal 508 (see FIG. 5). The longitudinal portion 608 has an outer diameter 607 (d1 which is r1·2). The longitudinal portion 610 has an outer diameter 609 (d2 which is r2·2). Force F1 (see FIG. 5) is defined by high-pressure acting on an area A1 defined in the embodiment shown by $(d1^2-d2^2)\cdot\pi/4$. The longitudinal portion 610 terminates in a foot 606 defined by dimensions length 614 (L) and width 612 (W). Force F2 (see FIG. 5) is defined by high-pressure acting on an area A2 defined in the embodiment shown by L·W. Force F3 (see FIG. 5) is defined by low-pressure acting on an area A3 defined in the embodiment shown by $L\cdot W+d2^2\cdot\pi/4$. Therefore, from manufacturing considerations, the following approximation applies:

$$W\times L\approx\pi(R^2-r^2) \tag{1}$$

The longitudinal force required to move the slider 407 downward is thus defined by:

$$F_{net}=P_2\cdot(A1-A2)+P_1\cdot(A3),\text{ wherein}$$

$F_{net}$ is the net longitudinal force needed to move the first slider 407 downward, $P_2$ is the pressure at the outlet 422, $P_1$ is the pressure at the inlet 427. In the embodiment shown, Eq (1) can be re-written as $$F_{net}=P_2\cdot((d1^2-d2^2)\cdot\pi/4-L\cdot W)+P_1\cdot(L\cdot W+d2^2\cdot\pi/4),\text{ wherein}$$

$d_1$ is the diameter of the longitudinal portion 608, $d_2$ is the diameter of the longitudinal portion 610, L is the length of the foot 606, and W is the width of the foot 606.

Figure 2:
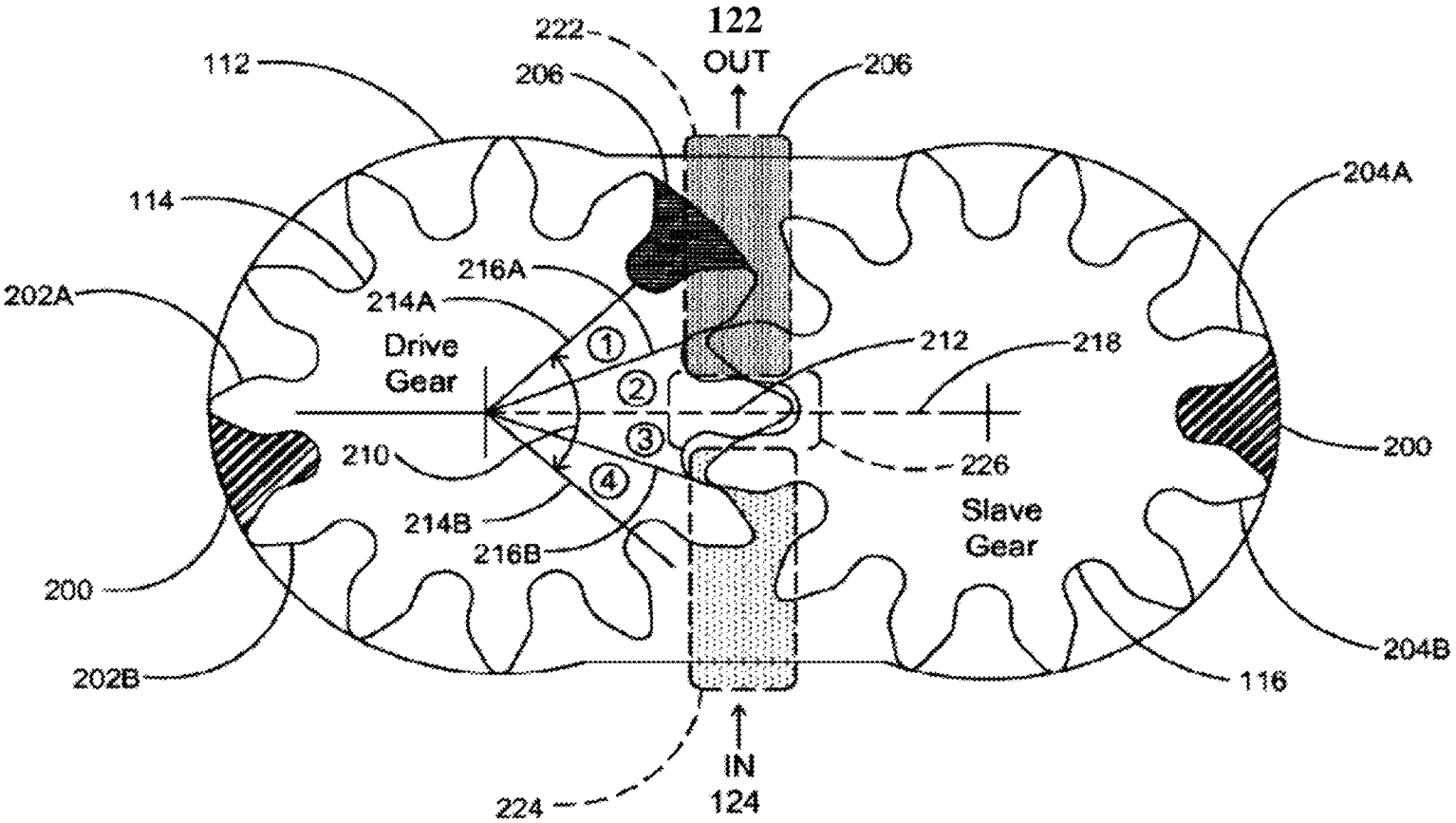
FIG. 2 (Prior Art)
FIG. 2 is a schematic view of the drive and driven gear of FIG. 1 in coupling with each other depicting teeth in engagement with respect to each other.
Figure 3:
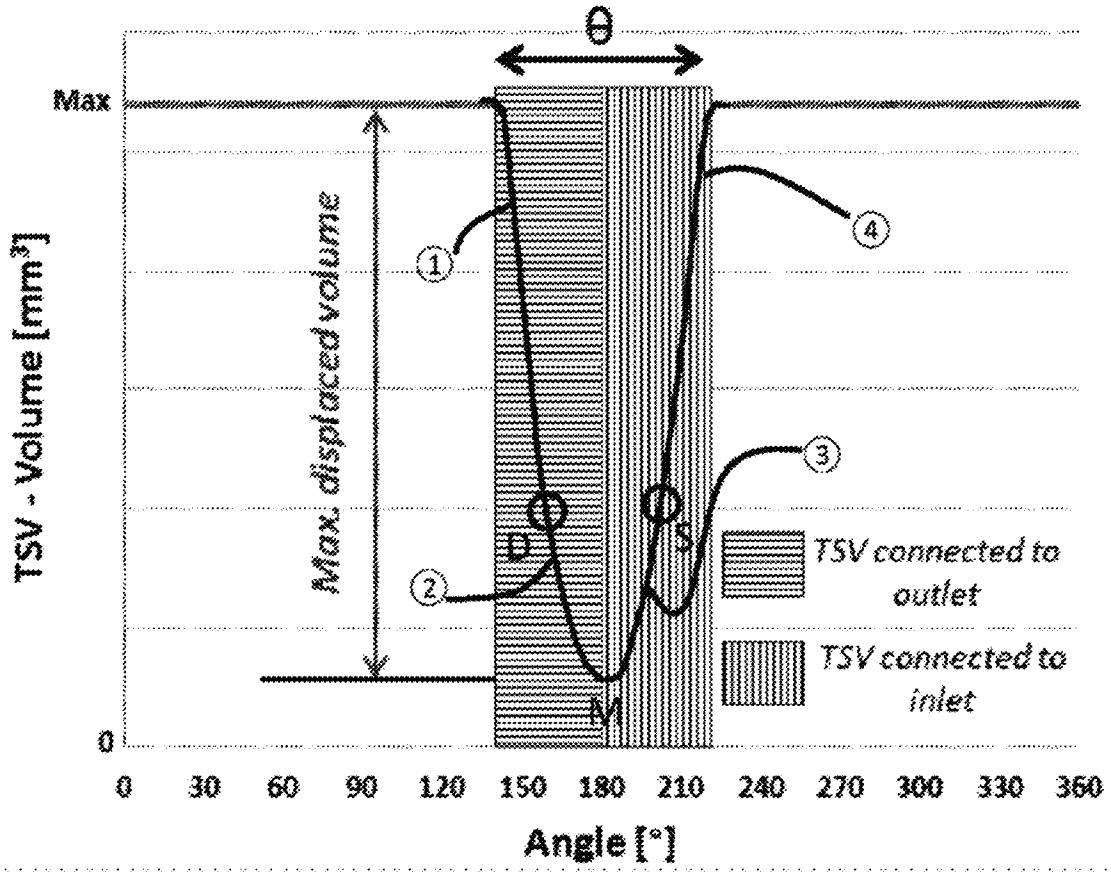
FIG. 3 (Prior Art)
FIG. 3 is a schematic graph of tooth space volume vs. angular position of the engaged teeth of FIG. 2.
Figure 7A:
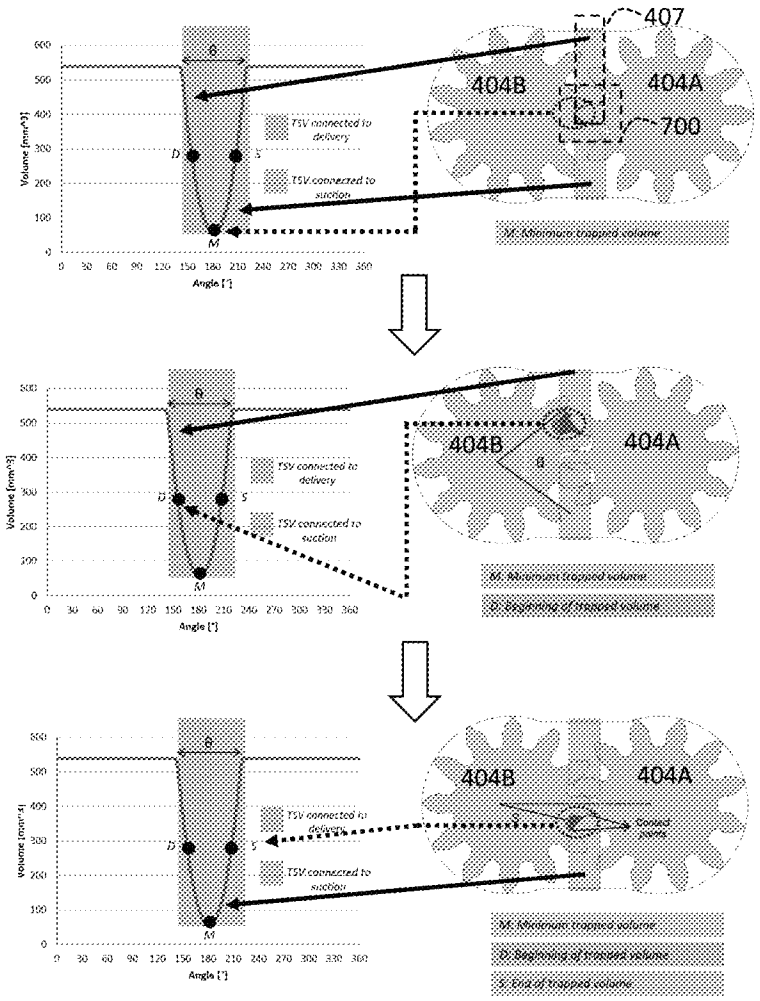
FIG. 7A is a schematic collection of graphs of tooth space volume vs. angular position of the engaged teeth of FIG. 4 showing a trapped volume of fluid as the drive and driven gears rotate, according to the present disclosure.

It should be appreciated that fluid disposed atop the foot 606 is in fluid communication with the outlet 422 (see FIG. 4) and fluid disposed below the foot 606 is in fluid communication with the inlet 424. Similar to the tooth space volume shown in FIG. 2, the location of the foot 606 with respect to the drive gear 404A and 404B (see FIG. 4)

determines the volumetric selection of fluid transfer from the inlet 424 to the outlet 422. Referring to FIG. 7A a schematic overview effect of slider position on fluid flow is provided. As shown in the top panel, with the slider position centrally within a mesh zone 700 of the drive gear and the drive gear 404A and driven gear 404B, the tooth space volume has a minimum trapped volume M. As shown in the middle panel, "D" representing the beginning of the trapped volume is equidistantly shown on the tooth space volume graph from "M" as is "M" from the end of the trapped volume ("S"). In the position of the slider 407 shown in FIG. 7A, maximum fluid flow is established from the inlet 424 to the outlet 422.

Figure 7B:
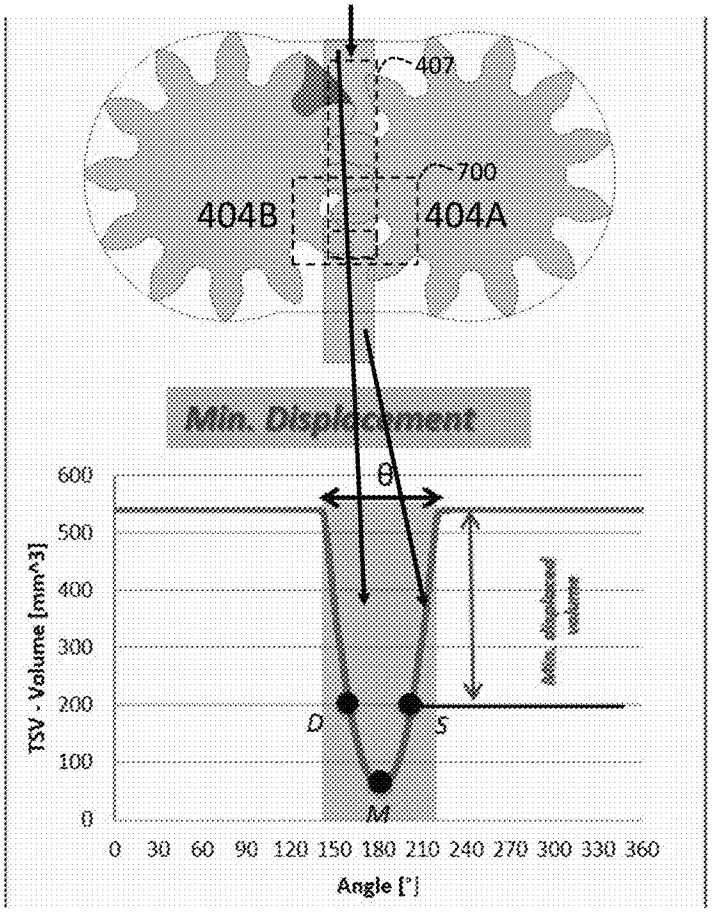
FIG. 7B is a schematic collection of graphs of tooth space volume vs. angular position of the engaged teeth of FIG. 4 showing changes in the tooth space volume as the position of the first slider changes, according to the present disclosure.
Figure 7B:
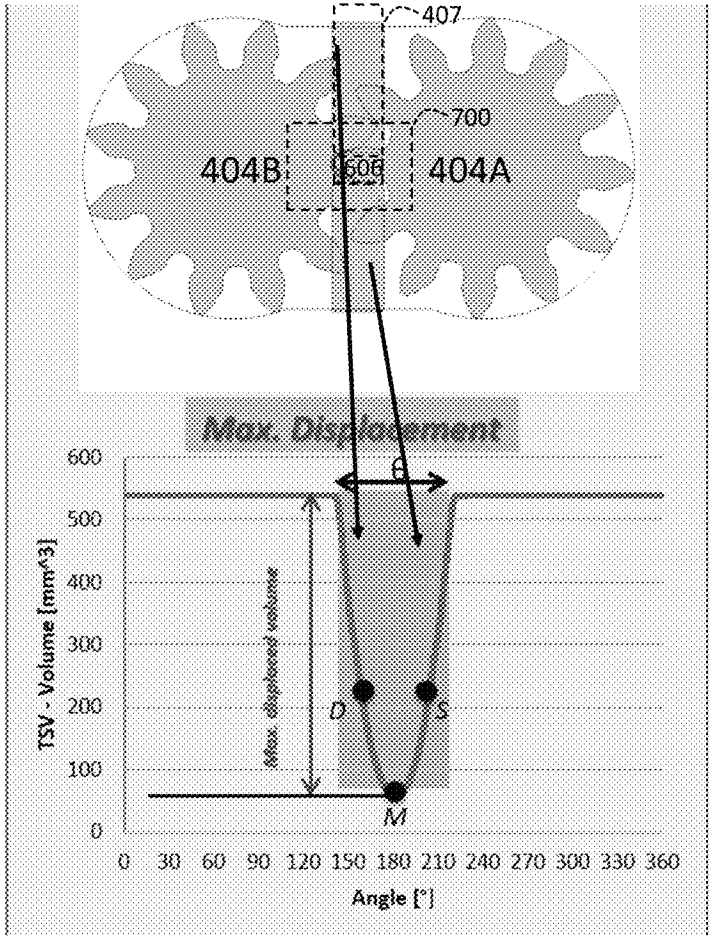

Referring to FIG. 7B, a schematic overview effect of slider movement on fluid flow is shown. As shown in the left panel (similar to FIG. 7A), when the foot 606 (shown in dashed lines) of the slider 407 (also shown in dashed lines) is centrally positioned with respect to the mesh zone 700, the point "M" is centrally positioned between maximum allowed fluid input from the inlet 424 and fluid output out of the outlet 422. However, when the slider 407 is moved downward, the maximum allowed fluid input from the inlet 424 is decreased thereby decreasing the volumetric fluid flow through the VD-EGM 400. It should be noted that if the slider 407 is allowed to travel downward beyond a threshold, the inlet 424 will be connected to the outlet 422, thereby rendering the VD-EGM 400 inoperative (i.e., no fluid flow). While not shown, if the slider 407 was to move upward from the position shown in the left panel of FIG. 7B, the maximum allowed fluid output out of the outlet 422 is decreased thereby decreasing the volumetric fluid flow through the VD-EGM 400. Similarly, it should be noted that if the slider 407 is allowed to travel upward beyond a threshold, the inlet 424 will be connected to the outlet 422, thereby rendering the VD-EGM 400 inoperative (i.e., no fluid flow).

Figure 7C:
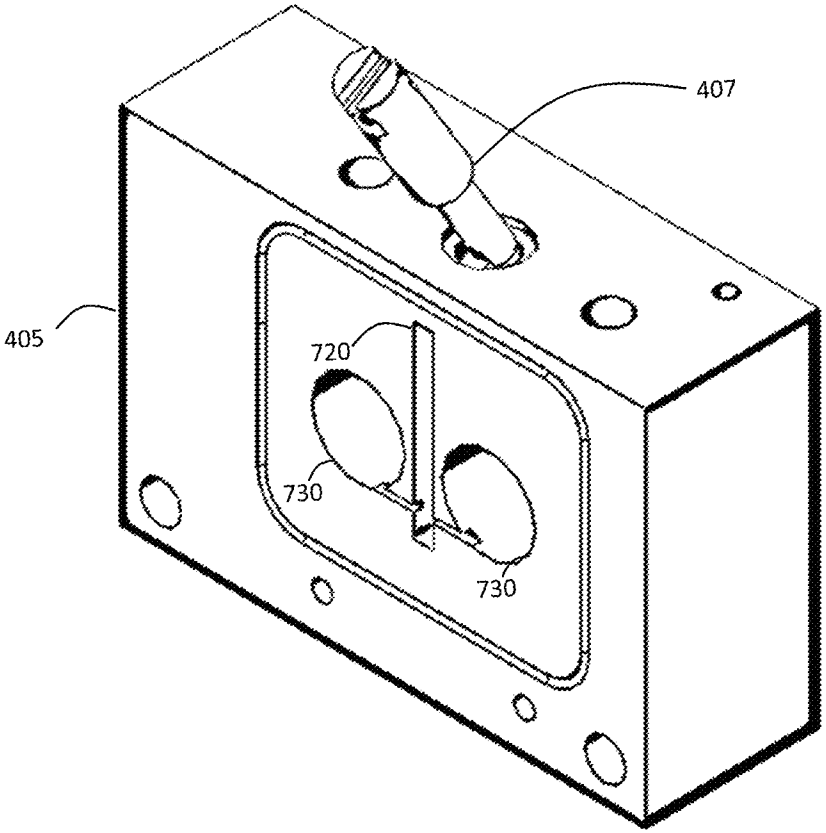
FIG. 7C is a perspective schematic view of a front cover also shown in FIG. 4, according to the present disclosure, depicting insertion of the first slider into the front cover.

Referring to FIG. 7C, a schematic representation of insertion the slider 407 into the front cover 405 is shown. In FIG. 7C, a sliding chamber 720 and two receiving collars 730 for the drive shaft and a shaft on which the driven gear is mounted are shown.

Figure 7D:
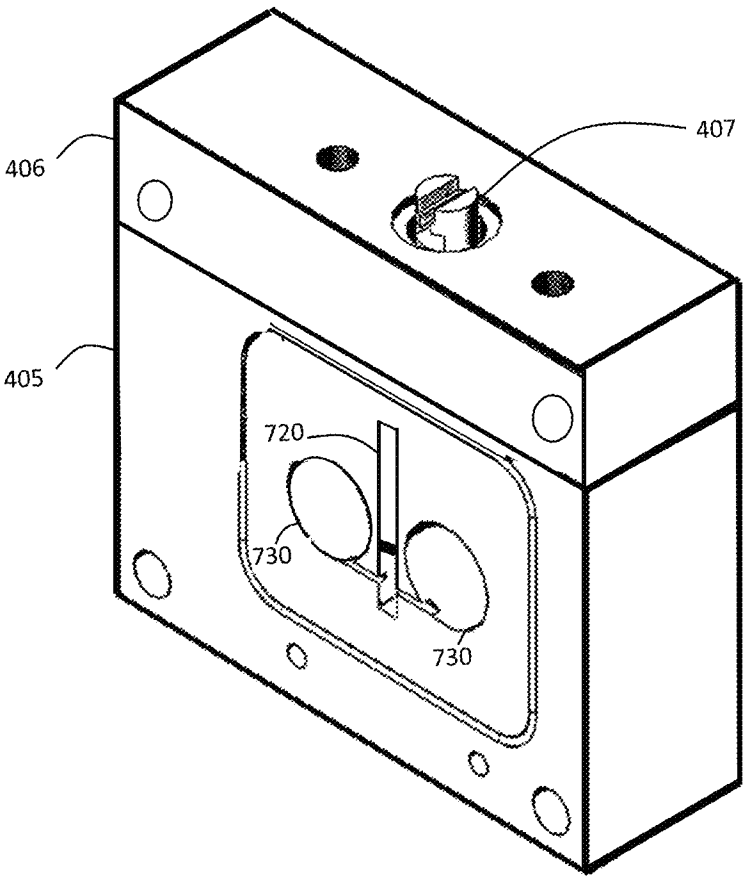
FIG. 7D is a perspective schematic view of the front cover of FIG. 7C, according to the present disclosure, depicting the first slider fully inserted into the front cover with a top plate, also shown in FIG. 4 placed atop the front cover.

Referring to FIG. 7D, a partially assembled VD-EGM 400 is shown with the slider 407 in place through the top plate 406 and the front cover 405.

Figure 8:
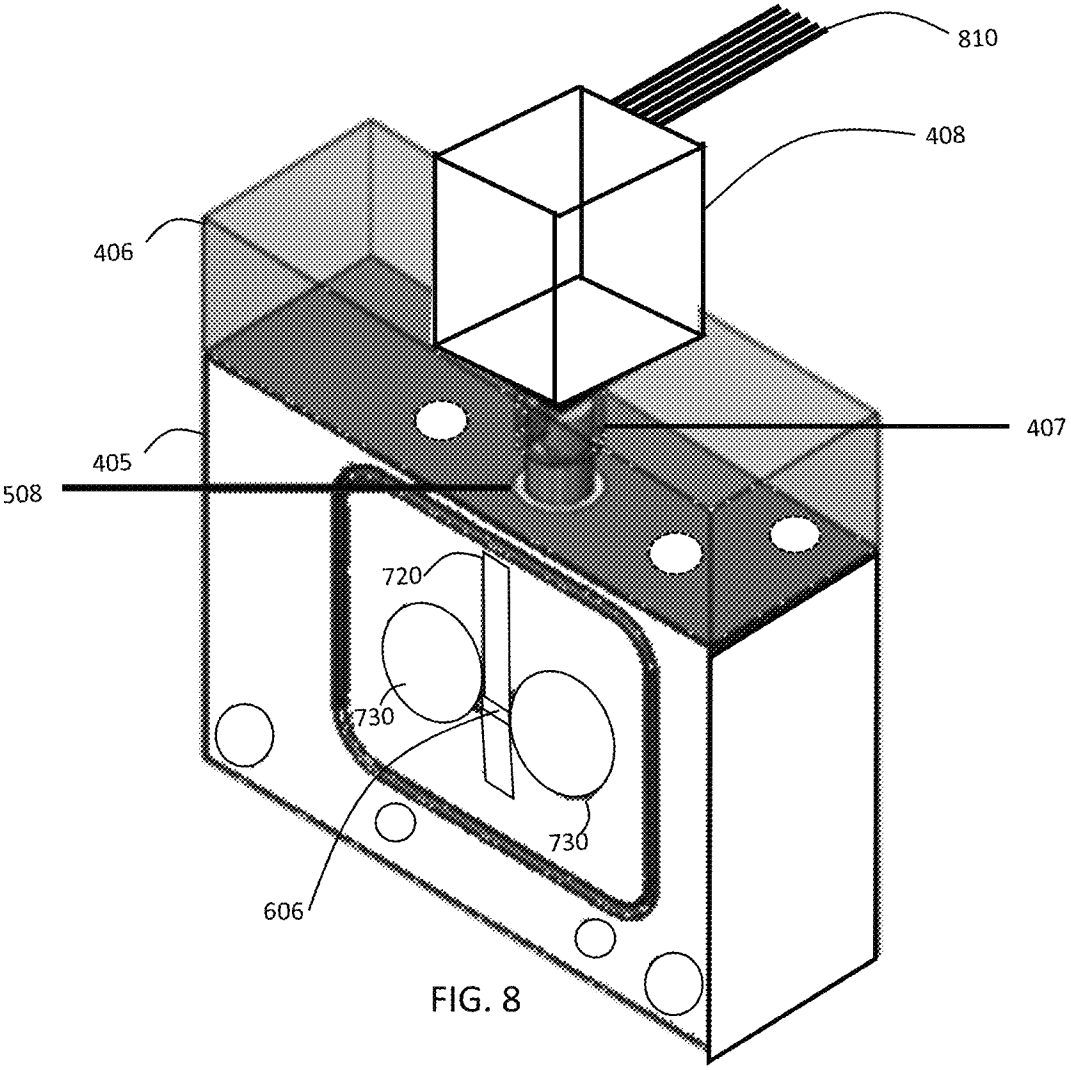
FIG. 8 is a perspective schematic view of the front cover, slider, and the top place of FIG. 7D, according to the present disclosure, further depicting an actuator, also shown in FIG. 4 placed atop the top plate.

Referring to FIG. 8, the actuator 408 is provided on top of the top plate 406 and coupled to the slider 407. The seal 508, provides a dynamic seal between the slider 407 and the front cover 405 and the top plate 406. The actuator 408 is activated by cables 810.

The actuator 408 (stepper, or other actuators as discussed below) control precisely the position of the slider, so that the flow of the VD-EGM 400 can be electronically set. The actuator utilizes negligible power (between about 0 and 0.1 W) when it is not actuated. This means that the electronic controller will consume energy only when the slider has to be moved to realize a different flow through the VD-EGM 400.

Figure 9:
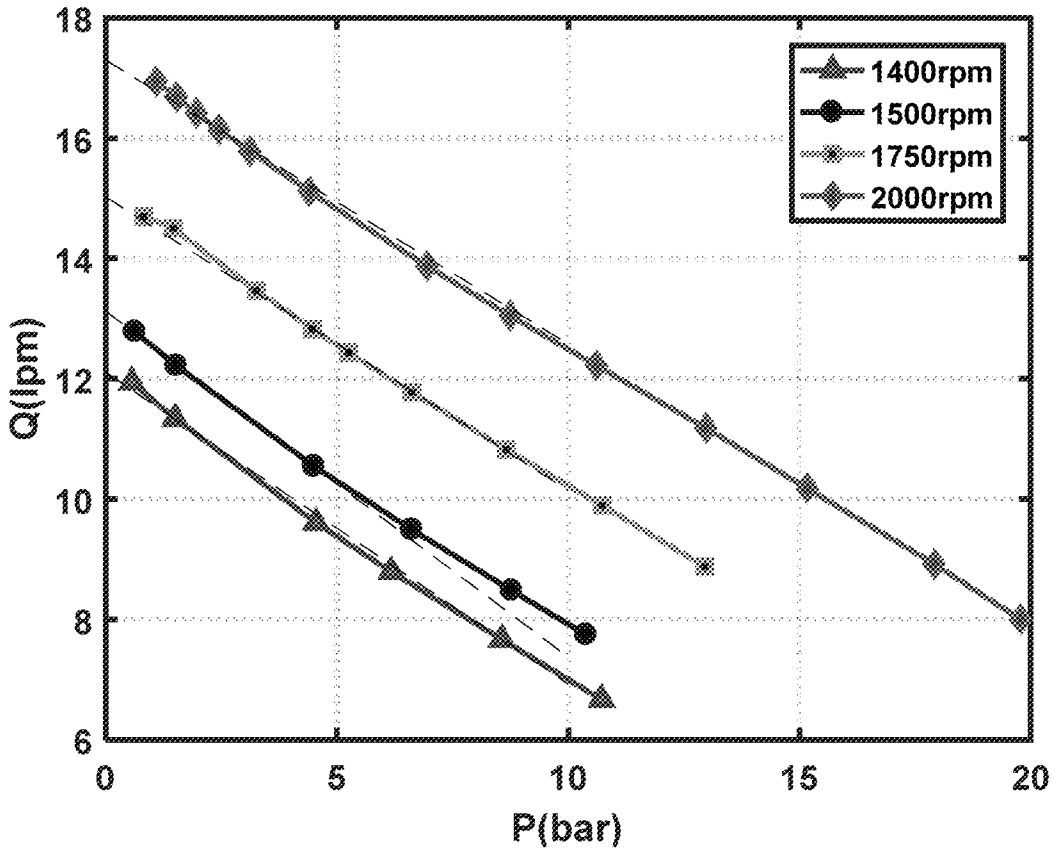
FIG. 9 is a graph of flow (lpm) vs. pressure (bar) for various rotational speeds of the drive gear, with the slider kept at maximum displacement.
Figure 10:
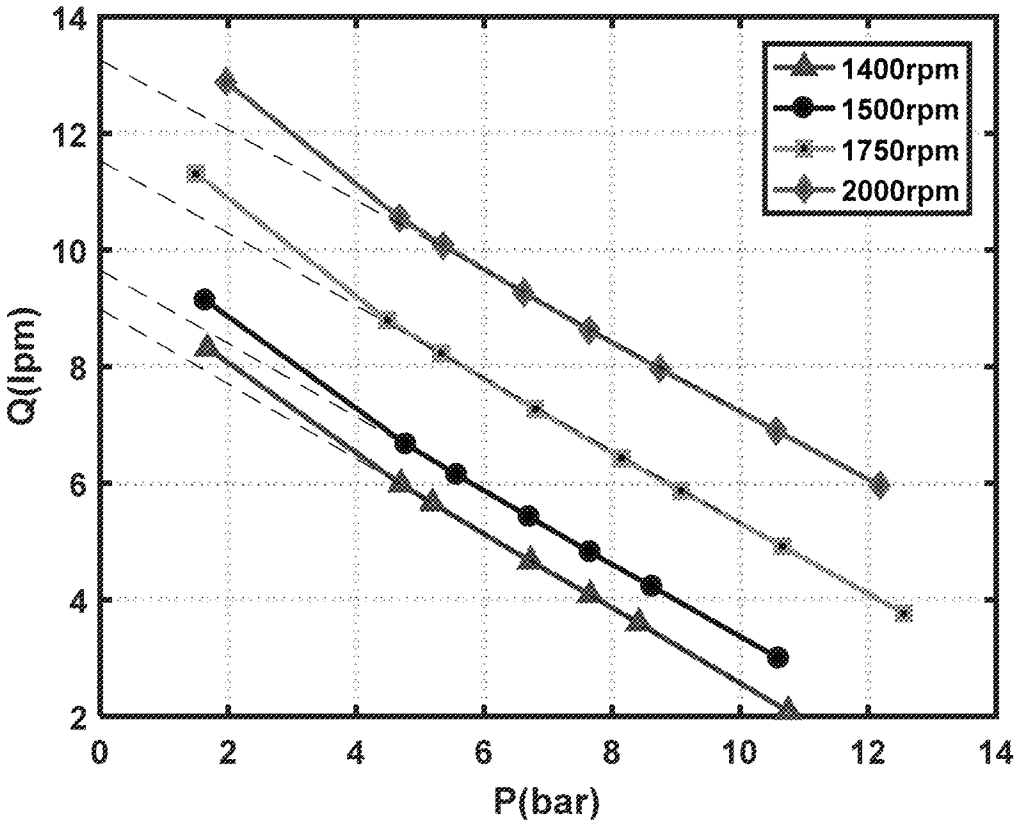
FIG. 10 is a graph of flow (lpm) vs. pressure (bar) for various rotational speeds of the drive gear, with the slider kept at minimum displacement.

Referring to FIGS. 9 and 10, flow vs pressure curves are provided based on measurements for several rotational speeds with the slider kept at maximum displacement and minimum displacement, respectively. With reference to FIG. 9, at maximum displacement, the resulting derived displacement is about $V_{d,max}$=8.87 $cm^3$/rev—the displacement is the y-intercept divided by the speed as provided in the legend, where the y-intercept gives flow rate at zero pressure which when divided by angular speed provides displacement. With reference to FIG. 10, similar experiments were performed with the slider kept at minimum displacement position, see the right panel of FIG. 7B. The resulting displacement is about $V_{d,min}$=6.31 $cm^3$/rev.

Figure 11:
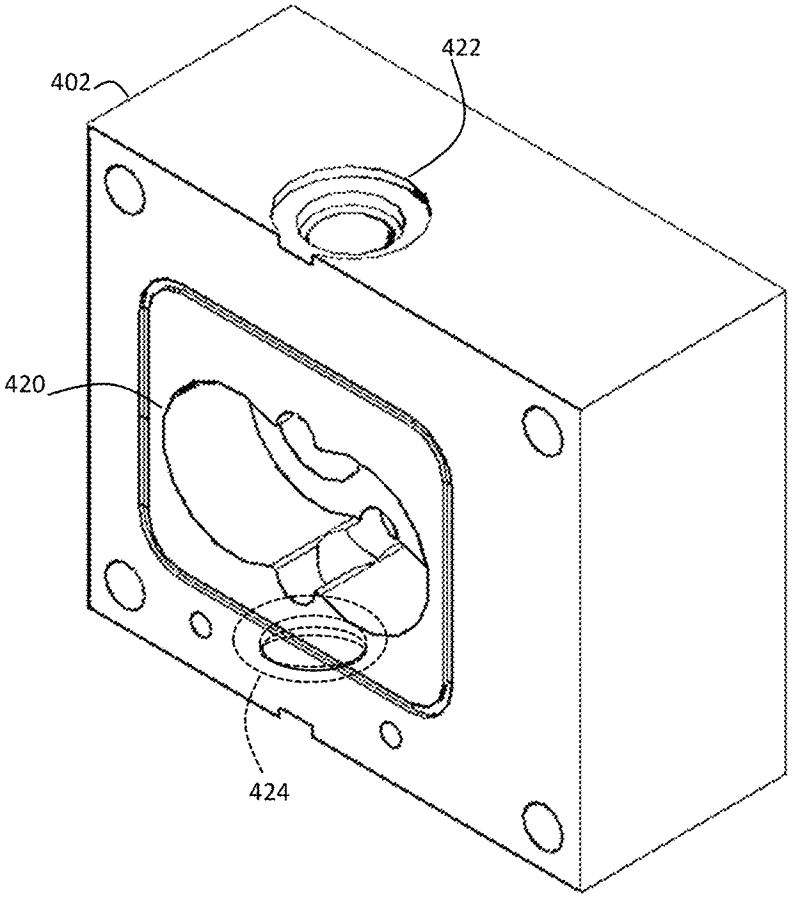
FIG. 11 is a perspective view of a back cover and casing also shown in FIG. 4, depicting an inlet and outlet.

FIG. 11 shows a schematic perspective view of the back cover and casing 402 showing the inlet 424 and the outlet 422 in relationship to each other and to the back cover and casing 402. The cavity 420 is shown in the back cover and casing 402 that is configured to receive drive gear 404A and the driven gear 404B.

Figure 12:
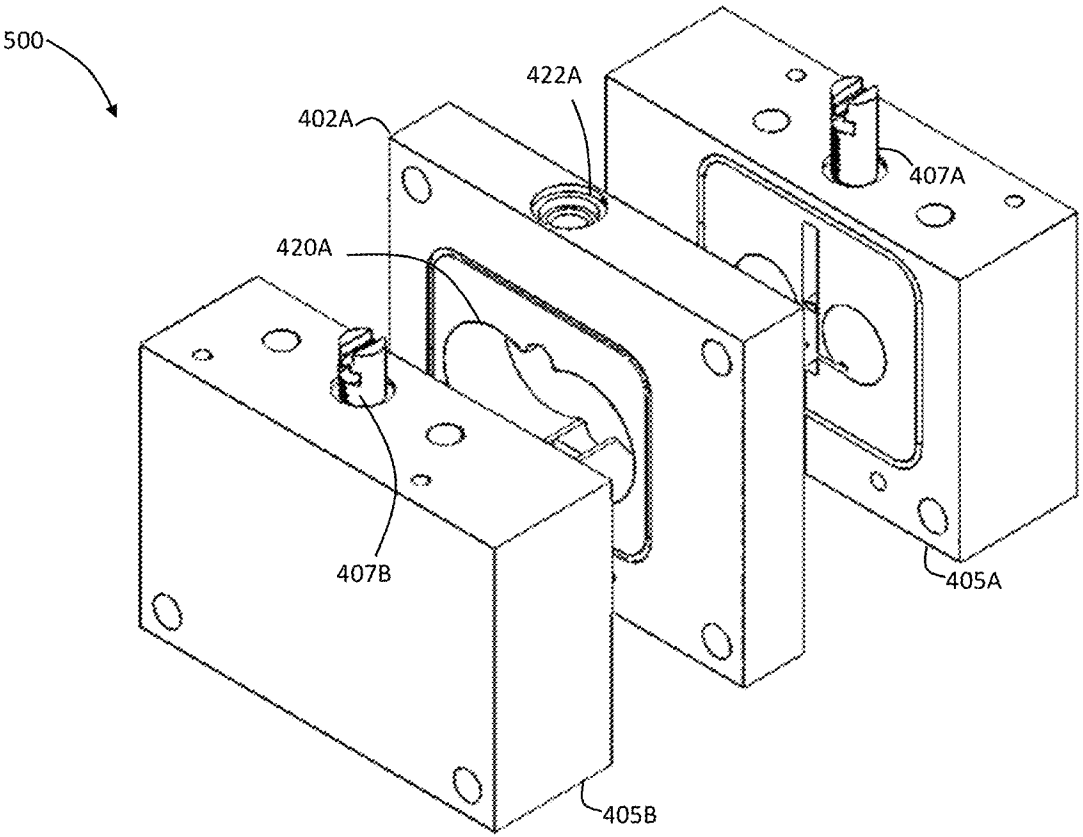
FIG. 12 is a schematic of another controlled variable delivery external gear machine (VD-EGM) according to the present disclosure depicting an exploded perspective view of various components including a front cover, a back cover, a casing having an inlet and an outlet, a first slider disposed in the front cover, and a second slider disposed in the back cover, the casing configured to receive a drive gear and a driven gear (not shown) each having a plurality of teeth (not shown), engaged therewith, the first slider and the second slider configured to balance pressure between lateral sides of the drive and driven gears.

FIG. 12 depicts another embodiment of a variable displacement external gear machine (VD-EGM) 500 where two sliders are used, one identified as 407A in the front cover 405A, as shown in FIG. 4, and one identified as 407B in a back cover 405B. A casing 402A is shown, having an outlet 422A and an inlet (not shown). Also, while not shown, a drive gear and driven gear are configured to be received within a cavity 420A disposed within the casing 402A. Also, while not shown, either a separate electrical actuation, or as discussed earlier with respect to the actuator 408 other electromechanical or electrohydraulic actuators known to a person having ordinary skill in the art, can be utilized to actuate the second slider 407B or the same electrical actuation used for the first slider 407A. The purpose for use of two sliders 407A and 407B is to provide a pressure balancing between the inlet 424 and the outlet 422. In other words, in high pressure applications, use of only one slider can generate lateral forces on the drive gear 404A and the driven gear 404B, resulting in pre-mature failure of internal components of the VD-EGM 400. In particular, the two-slider implementation shown in VD-EGM 500 causes the pressure distribution on the two lateral surfaces of the gears to be uniform. This ensures there is no lateral moment resulting from lateral forces and the gears are laterally balanced, thereby maintaining a lateral lubricating gap (not shown) which is sufficient and thus allows the internal components to bear the resulting load. At high pressures this lateral gap needs to be controlled to minimize leakages and to prevent contact between the gears lateral surface and the front and back covers 405A and 405B, thus resulting in low wear and longer life.

As discussed above, while an electrical actuation in the form of a stepper motor is described, herein, it should be appreciated that other types of actuation are within the scope of the present disclosure. For example, alternate actuation technologies include electrical (e.g., solenoid), manual, mechanical, e.g. using a lever or a cam, pneumatic, hydraulic, as well as other actuation techniques known to a person having ordinary skill in the art.

Figure 13B:
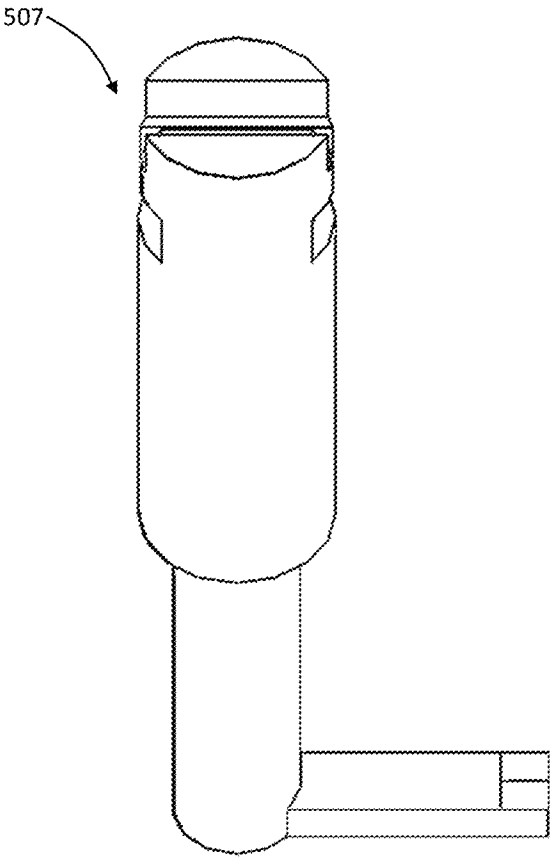
FIGS. 13A and 13B are front and perspective views, respectively, of a slider according to another embodiment, where the foot of the slider includes grooves.
Figure 13A:
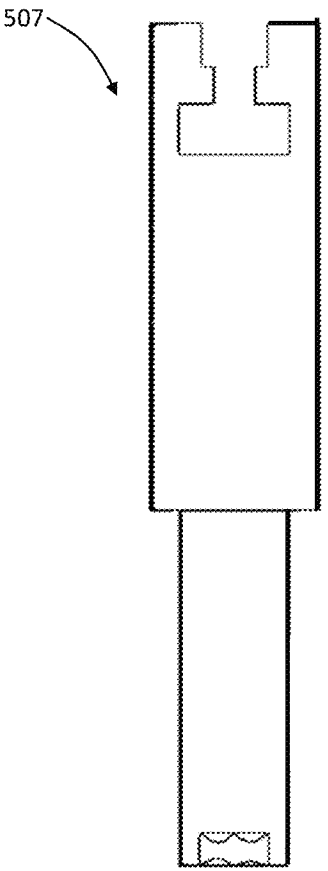

Referring to FIGS. 13A and 13B, front and perspective views, respectively, of a slider 507 according to another embodiment, of the present disclosure are presented. The slider 507 is similar to the slider 407 shown in FIG. 6, with one difference that the foot of the slider 507 includes grooves. In other aspects, not shown, the foot of the slider can have an elliptical cross section instead of a rectangular (as shown in FIG. 6) or a pseudo-rectangular as shown in FIGS. 13A and 13B. In yet other aspects, not shown, the foot of the slider can have a hybrid cross-section. The important aspect of the foot design is that when the foot of the slider 407 or 507 is coupled to a lateral side of the drive gear 404A and the driven gear 404B—or when the foot of the first slider 407A is coupled to a first lateral side of the drive gear 404A and a first lateral side of the driven gear 404B and the foot of second slider 407B is coupled to a second lateral side of the drive gear 404A and a second lateral side of the driven gear 404B—that a high-pressure zone coupled to the outlet 422 and a low-pressure zone coupled to the inlet 424 be generated about the first and second longitudinal portions of the respective slider(s), thereby generating the counterbalancing forces about these longitudinal portions requiring only a longitudinal force of between about 0 N and about 20 N to longitudinally move the respective slider.

In the present disclosure a combination of the front cover, the rear cover, and the back cover and casing are used synonymously as a housing.

While the variable delivery external gear machine (VD-EGM) of the present disclosure is described generally as a pump, it should be appreciated the VD-EGM of the present disclosure can be selectively operated as a pump or a motor.

Those having ordinary skill in the art will recognize that numerous modifications can be made to the specific implementations described above. The implementations should not be limited to the particular limitations described. Other implementations may be possible.

The invention claimed is:

1. A controlled variable delivery external gear machine (VD-EGM), comprising:

a housing;

an inlet formed in the housing and configured to receive fluid from a supply;

a drive gear disposed in the housing having a plurality of teeth;

a driven gear disposed in the housing having a plurality of teeth and configured to be driven by the drive gear, the drive gear configured to engage the driven gear in an angular mesh zone, tooth space volumes defined by tooth spaces between each two consecutive teeth of the drive gear and each two consecutive teeth of the driven gear configured to receive volumes of fluid from the inlet as the corresponding teeth rotate about the inlet;

an outlet formed in the housing and configured to receive at least some of the volume of fluid when the corresponding tooth space volumes in the angular mesh zone decrease as the corresponding teeth of the drive gear and driven gear come into contact with each other;

a first slider disposed in the housing comprising a first longitudinal portion connected to a second longitudinal portion receiving longitudinal forces from fluid pressure applied to the first and second longitudinal portions substantially cancel each other thereby requiring between about 0 N to about 20 N to longitudinally moving the first slider, selective configured to vary net operational volumes of fluid communication between the inlet and the outlet, for a given rotational speed of the drive gear; and a first drive mechanism coupled to the first slider and configured to cause the first slider to slide in a longitudinal direction.

2. The VD-EGM of claim 1, wherein the first longitudinal portion of the first slider is connected to the second longitudinal portion at a distal end of the second longitudinal portion, and further comprising a foot connected to a proximal end of the second longitudinal portion, the foot having a cross-section such that when the foot of the first slider is coupled to a first lateral side of the drive gear and a first lateral side the driven gear, a high-pressure zone fluidly coupled to the outlet and a low-pressure fluidly coupled to the inlet are generated about the first and second longitudinal portions of the first slider.

3. The VD-EGM of claim 2, wherein the first drive mechanism includes one or more of a stepper motor, a solenoid, a lever, a cam, a hydraulic activation mechanism, and a pneumatic activation mechanism.

4. The VD-EGM of claim 3, wherein the longitudinal forces required to longitudinally move the first slider is governed by:

$F_{net1}=P_2\cdot(A_{11}-A_{21})+P_1\cdot(A_{31}+A_{21})$, wherein $F_{net1}$ is the net longitudinal force needed to move the first slider longitudinally, $P_2$ is the pressure at the outlet, $P_1$ is the pressure at the inlet, $A_{11}$ is a cross-sectional of the first longitudinal portion of the first slider, $A_{21}$ is a cross-sectional area of the second longitudinal portion of the first slider, and $A_{31}$ is a cross-sectional area of the foot of the first slider.

5. The VD-EGM of claim 4, wherein the first and second longitudinal portions of the first slider are cylindrical in shape and cross-section of the foot of the first slider is rectangular.

6. The VD-EGM of claim 5, wherein $F_{net1}$ is further governed by:

$F_{net1}=P_2\cdot((d_{11}^2-d_{21}^2)\cdot\pi/4-L_1\cdot W_1)+P_1\cdot(L_1\cdot W_1+d_{21}^2\cdot\pi/4)$, wherein $d_{11}$ is the diameter of the first longitudinal portion of the first slider, $d_{21}$ is the diameter of the second longitudinal portion of the first slider, $L_1$ is the length of the foot of the first slider, and $W_1$ is the width of the foot of the first slider.

7. The VD-EGM of claim 4, wherein the cross section of the first and second longitudinal portions of the first slider are elliptical in shape.

8. The VD-EGM of claim 7, wherein the cross-section of the foot of the first slider includes grooves.

9. The VD-EGM of claim 7, wherein the foot of the first slider has an elliptical cross-section.

10. The VD-EGM of claim 4, further comprising a second slider disposed in the housing separated from the first slider by the drive gear and the driven gear, comprising a first longitudinal portion connected to a second longitudinal portion such that longitudinal forces applied to the first and second longitudinal portions of the second slider substantially cancel each other thereby requiring between about 0 N to about 20 N to longitudinally move the second slider, selective positioning of the second slider configured to vary net operational volumes of fluid communication between the inlet and the outlet, for a given rotational speed of the drive gear and to balance lateral pressure forces acting on the drive gear and the driven gear; and a second drive mechanism coupled to the second slider and configured to cause the second slider to slide in a longitudinal direction.

11. The VD-EGM of claim 10, wherein the first longitudinal portion of the second slider is connected to the second longitudinal portion at a distal end of the second longitudinal portion, and further comprising a foot connected to a proximal end of the second longitudinal portion, the foot having a cross-section such that when the foot of the second slider is coupled to a second lateral side of the drive gear and a second lateral side the driven gear, the high-pressure zone and the low-pressure fluidly are formed about the first and second longitudinal portions of the second slider.

12. The VD-EGM of claim 11, wherein the second drive mechanism includes one or more of a stepper motor, a solenoid, a lever, a cam, a hydraulic activation mechanism, and a pneumatic activation mechanism.

13. The VD-EGM of claim 12, wherein the longitudinal forces required to longitudinally move the second slider is governed by:

$F_{net2}=P_2\cdot(A_{12}-A_{22})+P_1\cdot(A_{32}+A_{22})$, wherein $F_{net2}$ is the net longitudinal force needed to move the first slider longitudinally, $P_2$ is the pressure at the outlet, $P_1$ is the pressure at the inlet, $A_{12}$ is a cross-sectional of the first longitudinal portion of the second slider, $A_{22}$ is a cross-sectional area of the second longitudinal portion of the second slider, and $A_{32}$ is a cross-sectional area of the foot of the second slider.

14. The VD-EGM of claim 12, wherein the first and second longitudinal portions of the second slider are cylindrical in shape and cross-section of the foot of the second slider is rectangular.

15. The VD-EGM of claim 14, wherein $F_{net2}$ is further governed by:

$F_{net2}=P_2\cdot((d_{12}^2-d_{22}^2)\cdot\pi/4-L_2\cdot W_2)+P_1\cdot(L\cdot W_2+d_{22}^2\cdot\pi/4)$, wherein $F_{net2}$ is the net longitudinal force needed to move the second slider downward, $P_2$ is the pressure at the outlet, $P_1$ is the pressure at the inlet, $d_{12}$ is the diameter of the first longitudinal portion of the second slider, $d_{22}$ is the diameter of the second longitudinal portion of the second slider, $L_2$ is the length of the foot of the second slider, and $W_2$ is the width of the foot of the second slider.

16. The VD-EGM of claim 12, wherein the cross section of the first and second longitudinal portions of the first slider are elliptical in shape.

17. The VD-EGM of claim 16, wherein the cross-section of the foot of the first slider includes grooves.

18. The VD-EGM of claim 16, wherein the foot of the first slider has an elliptical cross-section.

19. The VD-EGM of claim 10, where the first drive mechanism and the second drive mechanism are the same drive mechanism.

20. The VD-EGM of claim 1, wherein the VD-EGM is selectively operated as a motor and a pump.

* * * * *